United States Patent [19]

Olson

[11] 4,141,160

[45] Feb. 27, 1979

[54] CUTTING EDGE WITH WEAR-RESISTANT MATERIAL

[75] Inventor: Harris S. Olson, Morton, Ill.

[73] Assignee: Caterpillar Tractor Co., Peoria, Ill.

[21] Appl. No.: 829,682

[22] Filed: Sep. 1, 1977

[51] Int. Cl.[2] ..... E02F 9/28; B22D 23/08

[52] U.S. Cl. ..... 37/141 R; 37/141 T; 172/719; 75/126 P; 75/0.5 B

[58] Field of Search ..... 37/141 R, 141 T, 142 R; 172/719; 75/126 P, 0.5 B

[56] References Cited

U.S. PATENT DOCUMENTS

| | | | |
|---|---|---|---|
| 1,835,701 | 12/1931 | Edmunds | 37/142 R |
| 2,051,234 | 8/1936 | Wiese | 172/719 |
| 2,739,395 | 3/1956 | Stratton | 37/142 R |
| 3,529,677 | 9/1970 | Stephenson | 37/141 R X |
| 3,790,353 | 2/1974 | Jackson | 37/141 T X |
| 3,805,423 | 4/1974 | Engel et al. | 172/719 |
| 3,882,594 | 5/1975 | Jackson et al. | 172/719 X |
| 3,888,027 | 6/1975 | Toews | 172/719 X |
| 3,934,654 | 1/1976 | Stephenson | 172/719 |
| 3,970,445 | 7/1976 | Gale et al. | 75/0.5 B |
| 4,011,051 | 3/1977 | Helton et al. | 75/202 X |

FOREIGN PATENT DOCUMENTS

| | | | |
|---|---|---|---|
| 960035 | 12/1974 | Canada | 37/41 |

*Primary Examiner*—E. H. Eickholt

*Attorney, Agent, or Firm*—Wegner, Stellman, McCord, Wiles & Wood

[57] ABSTRACT

A wear-resistant alloy is inlaid in channels along the undersurface of a cutting edge of a ground-engaging implement. The channels include a front channel adjacent to the front cutting edge, and channels extending rearwardly from the front channel along the sides of the implement. The wear-resistant material is cast in the form of blocks and brazed in the channels. Additional wear-resistant material may be provided at the corners where the front channel intersects the channels along the sides.

8 Claims, 4 Drawing Figures

CUTTING EDGE WITH WEAR-RESISTANT MATERIAL

BACKGROUND OF THE INVENTION

This invention relates to an improved cutting edge for ground-engaging implements and, more particularly, to a bolt-on cutting edge assembly with a wear-resistant alloy. The ground-engaging implement, as a loader bucket, of an earth-working machine is subject to severe wear as a result of heavy abrasion from the direct engagement of the cutting edge with clay, igneous and sedimentary rock, sand, ores and the like. Cutting edges of high carbon steel wear rapidly if in constant contact with the ground. To minimize the problem of maintenance and wear and tear on the parts, sectional and replaceable cutting edges have been developed which can be interchanged with an expired blade at the job site. Also, wear-resistant alloys made especially for ground-engaging cutting edges have been developed. These alloys are of boron, chromium and iron and have maximum hardness for a given composition. The wear-resistant alloys are in the form of spheroidal particles held together in a matrix formed by a material different from the alloy. Such material is described in U.S. Pat. No. 3,970,446 to Gale et al and in U.S. Pat. No. 4,011,051 to Helton et al, both assigned to Caterpillar Tractor Co., Peoria, Illinois.

These alloys are relatively expensive and are cast in the shape of small blocks or ingots and, as shown in FIG. 3 of U.S. Pat. No. 4,011,051, can be brazed along the distal portion of a motor grader cutting edge. Although this configuration is acceptable for many types of ground-engaging implements, it is not for others. Loader buckets, for example, have a tendency to wear more rapidly along the sides and at the corners where the sides meet the front cutting edge. A single strip of ingots or blocks laid end to end, as in U.S. Pat. No. 4,011,051, might be of some help, but would prevent maximum utilization of the wear material.

Considering the expense of the alloy described in the above-mentioned patents and the desirability of providing the ground-engaging edge with it, I have developed an effective, yet economical and practical, way of combining the alloy with a cutting edge assembly for a more effective tool having a longer life.

SUMMARY OF THE INVENTION

The present invention is directed to overcoming one or more of the problems as set forth above.

According to the present invention, downwardly opening channels are provided along the lower surface of a bolt-on cutting edge assembly for a ground-engaging implement, as a loader bucket. A front channel is located generally parallel to the cutting edge. Side channels extend rearwardly from the front channel and parallel to the sides of the assembly. Rectangular blocks or ingots of a wear-resistant alloy are inlaid within the channels for added wear along the ground-engaging forward edge and the sides. The cutting edge assembly may be constructed in sections, as a left, a middle and a right section. Also, the left and right sections may be provided with added wear-resistant alloy at the corners to enhance the life of the section.

DESCRIPTION OF THE PREFERRED EMBODIMENT

Figure 1:
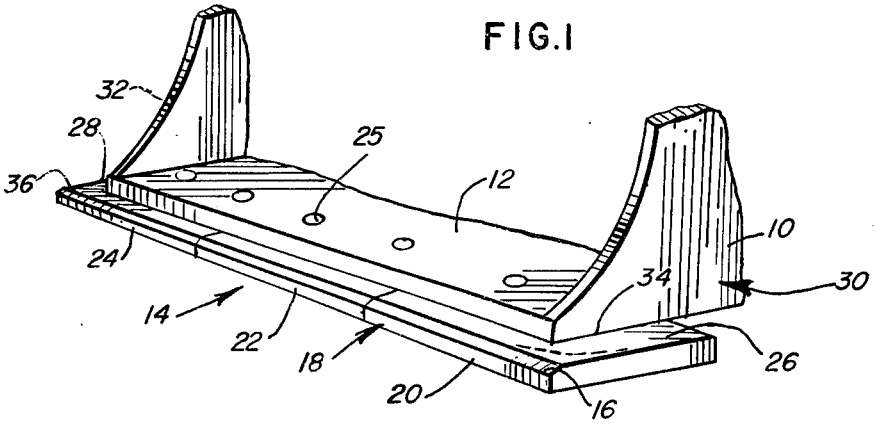
FIG. 1 is a perspective view of the wear-resistant cutting edge assembly coupled to an earth-working machine.

Referring to FIG. 1, a ground-engaging earth-working equipment 10, as a loader bucket, for example, has a base 12 on which is bolted cutting edge assembly 14. The assembly may have a bevel 16 extending across the forward edge 18 of the assembly to enhance penetration of the ground-engaging tool. The cutting edge assembly 14 may be a single unit or may be constructed of a left section 20, a middle section 22 and a right section 24 with respect to the operator (not shown). Sectional construction of the assembly is preferred since selective replacement of any one of the three sections is easily effected. Also, since the individual sections are heavy and not easily manipulated, sectional construction facilitates on-site replacement. The assembly is secured to base 12 by bolts extending through bores 25 in the base and through similar bores in the cutting edge. Edges 26 and 28 extend outwardly from sides 30 and 32, respectively and, as will be explained in greater detail below, the corners 34 and 36 formed by the intersection of the sides with the forward cutting edge 18 are subject to a high degree of wear, and generally wear in a manner indicated by the dotted line.

Figure 2:
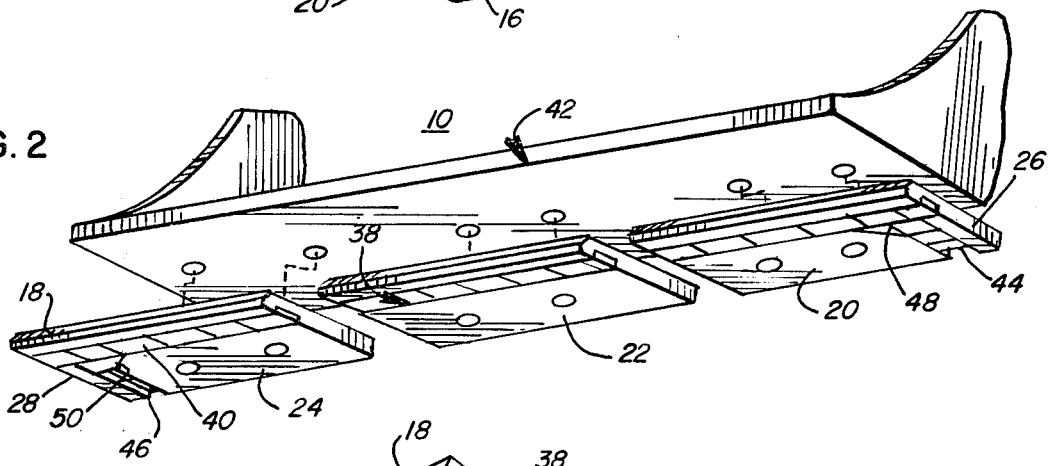
FIG. 2 is a perspective view depicting the underside of the cutting edge assembly shown in FIG. 1.

Referring to FIG. 2, the lower sides of left section 20, middle section 22 and right section 24 are shown. Along forward cutting edge 18 there extends a front channel 38 in each of the three sections inlaid with wear-resistant alloy blocks or ingots, as block 40. Front channel 38 extends forwardly of edge 42 of base 12 and its axis is generally perpendicular to the motion of the earth-working equipment 10. Side channels 44 and 46 extend rearwardly from front channel 38 along the edges 26 and 28 of left section 20 and right section 24, respectively. Channels 44 and 46, having an axis generally parallel to the movement of the earth-working machine, form corners 48 and 50 which extend forwardly and outwardly from edge 42 and sides 30 and 32 at the intersection with the front channel 30. Ingots or blocks 40 of wear-resistant alloy are laid in side channels 44 and 46 and may extend rearwardly to the end of the side channels, or partially to the end. A larger amount of wear-resistant alloy is provided at corners 48 and 50 since the inner corner of the intersection of channels 46 and 48 is removed and inlaid with more wear-resistant material.

Figure 3:
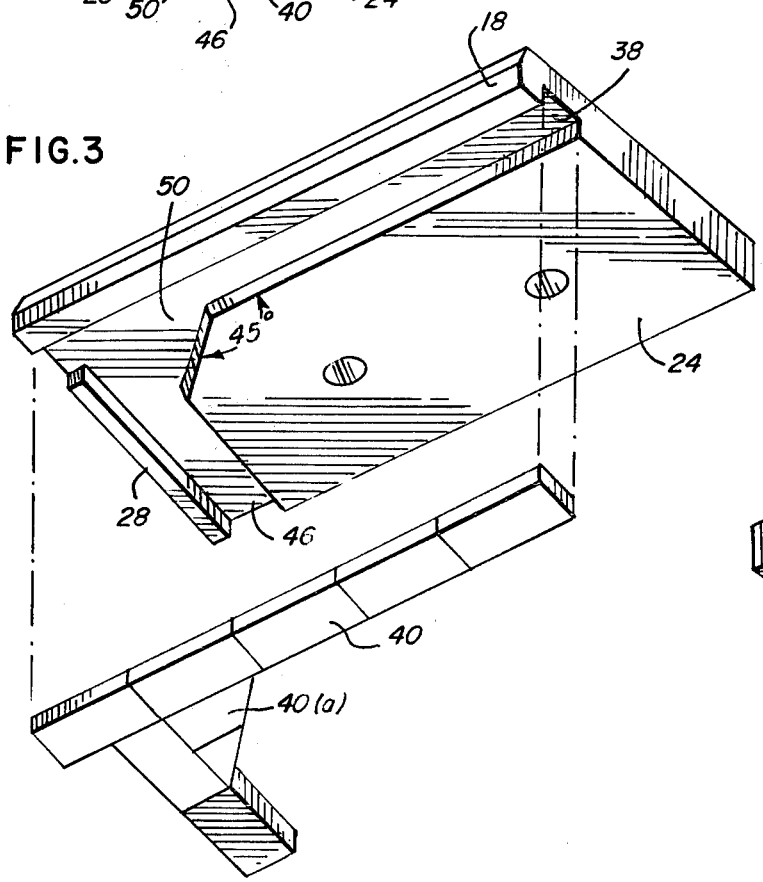
FIG. 3 is a detailed perspective view of the wear-resistant material inserted within a channel on the right section of the wear-resistant cutting edge of FIG. 2; and, FIG. 4 is an individual rectangular block or ingot typifying the shape in which the wear-resistant material is cast.

Referring to FIG. 3, an explanation of the construction of the right assembly 24 will be provided, it being understood that left section 16 is similarly constructed. Right assembly 24 is of carbon steel, approximately 1⅛" thick. The width of the assembly is approximately 13" and the length is approximately 30", although it should be understood that the depth, the width and the thickness of the material substantially depends on the size of the earth-working equipment.

Front channel 38 extends along forward edge 18 with approximately 1" between the channel and the forward edge. Side channel 46 is generally perpendicular to the front edge and the outer edge of the channel is approximately ½" from edge 28. Channels 38 and 46 are approximately 2" wide and ¾" deep, it being anticipated that the rectangular blocks, as block 40, are to be brazed therein. The blocks need not extend rearwardly to the end of channel 46. The inner corner of the inner section of the channels may be bisected, as by 45°, to provide added volume for additional wear-resistant alloy blocks 40*a*.

Although the wear-resistant alloy contemplated by the present invention is described in U.S. Patents 3,970,445 and 4,011,051, a brief description of it will be provided here for convenience. The alloy consists of spheroidal particles that have a composition of about 58% chromium, 9% boron, with the remainder iron, surrounded by a matrix alloy of iron and boron in the amounts of about 3.8% boron and the remainder iron. The spheroidal particles are captured in the matrix and should be sufficiently closely spaced to block wear paths when abrasive wear occurs in the composite alloy material.

Figure 4:
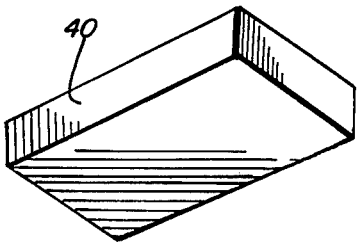

The composite alloy may be formed by casting the matrix alloy about the hard spheroids in a ceramic or graphite mold of the desired shape as a rectangular shape shown in FIG. 4. After brazing in a vacuum furnace, the block of composite alloy is cooled to room temperature.

The blocks or ingots so formed are inlaid within the channels and joined to the metal section and to each other by brazing or by any other appropriate method. Brazing tends to weaken the steel of the section. A weakened section can be subjected to conventional heat treatment to harden it without adversely affecting the composite alloy material. Also, the blocks may be suitably fractured or cut and fit into the channels as, for example, about the bisected inner corner discussed above.

The embodiments of the invention in which an exclusive property or privilege is claimed are defined as follows:

1. In a cutting edge assembly for an earthworking machine having a forwardly directed front cutting edge and at least one side edge extending rearwardly from the forward cutting edge, the assembly being in the form of a flat plate, the improvement comprising:

a front channel extending generally parallel to but inwardly spaced from the cutting edge;

a side channel extending generally parallel to but inwardly spaced from said side edge; and individual rectangular wear-resistant blocks inlaid side by side within the front channel and the side channel so that an upper surface of the blocks is coincident with the surface of the flat plate.

2. In a cutting edge assembly as claimed in claim 1 wherein two side edges extend rearward from the front cutting edge, a side channel extends rearward from the front channel along each of said two side edges, and wear-resistant material is inlaid in each of said side channels.

3. In a cutting edge assembly for an earthworking machine having a forwardly directed front cutting edge and side edges extending rearwardly from the forward cutting edge, the assembly being in the form of a flat plate, the improvement comprising:

a front channel extending parallel to but inwardly spaced from the front cutting edge;

a first and a second side channel extending rearwardly from the front channel and generally parallel to but inwardly spaced from the side edges; and individual wear-resistant blocks formed of an alloy having spheroidal particles retained by a matrix alloy inlaid side by side within the front channel and the first and second side channels so that an upper surface of the blocks is coincident with the surface of the flat plate, wherein the front channel intersects the first and the second side channels to form corners and said blocks extend to said side edges only at said corners.

4. The cutting edge assembly of claim 3 wherein the wear-resistant material is formed of an alloy having spheroidal particles retained by a matrix alloy.

5. The cutting edge assembly of claim 4 wherein the spheroidal particles are of boron, chromium and iron and the matrix alloy is of iron and boron.

6. The cutting edge assembly of claim 3 wherein the blocks are brazed to each other and to the channel.

7. The cutting edge assembly of claim 3 wherein the assembly is constructed in a plurality of sections.

8. The cutting edge assembly of claim 3 wherein the wear-resistant alloy blocks consist of spheroidal particles of about 58% chromium, 9% boron and the remainder iron, surrounded by a matrix alloy of about 3.8% boron with the remainder iron.

* * * * *